US008061564B2

(12) United States Patent
Frates

(10) Patent No.: US 8,061,564 B2
(45) Date of Patent: Nov. 22, 2011

(54) LIQUID DISPENSING APPARATUS INCLUDING AN ATTACHMENT MEMBER

(75) Inventor: Paul S. Frates, Lawrenceville, GA (US)

(73) Assignee: Nordson Corporation, Westlake, OH (US)

( * ) Notice: Subject to any disclaimer, the term of this patent is extended or adjusted under 35 U.S.C. 154(b) by 949 days.

(21) Appl. No.: 11/928,650

(22) Filed: Oct. 30, 2007

(65) Prior Publication Data

US 2008/0110939 A1 May 15, 2008

Related U.S. Application Data

(60) Provisional application No. 60/865,886, filed on Nov. 15, 2006.

(51) Int. Cl.
*B67D 7/80* (2010.01)

(52) U.S. Cl. ..... 222/146.5; 222/540; 239/296

(58) Field of Classification Search ..... 222/146.5, 222/504, 296, 298, 390, 505, 146.2; 239/296, 239/298, 390, 591, 600, 556; 425/188
See application file for complete search history.

(56) References Cited

U.S. PATENT DOCUMENTS

| | | | | |
|---|---|---|---|---|
| 3,791,360 | A | 2/1974 | Reiger | |
| 5,407,101 | A * | 4/1995 | Hubbard | 222/146.5 |
| 5,535,919 | A | 7/1996 | Ganzer et al. | |
| 6,164,568 | A | 12/2000 | Muller et al. | |
| 6,210,141 | B1 * | 4/2001 | Allen | 425/7 |
| 6,354,463 | B1 | 3/2002 | Pahl | |
| 6,358,322 | B1 | 3/2002 | Pahl | |
| 6,378,784 | B1 * | 4/2002 | Allen et al. | 239/296 |
| 6,619,566 | B2 | 9/2003 | Gressett, Jr. et al. | |
| 6,669,057 | B2 | 12/2003 | Saidman et al. | |
| 6,676,038 | B2 | 1/2004 | Gressett, Jr. et al. | |
| 7,156,261 | B2 | 1/2007 | Saidman et al. | |
| 7,490,737 | B2 * | 2/2009 | Cocciadiferro et al. | 222/145.5 |
| 2005/0236438 | A1 | 10/2005 | Chastine et al. | |
| 2006/0097010 | A1 | 5/2006 | Riney | |

FOREIGN PATENT DOCUMENTS

| | | | |
|---|---|---|---|
| EP | 1 308 217 | A2 | 5/2003 |
| EP | 1 588 777 | A2 | 10/2005 |

OTHER PUBLICATIONS

European Patent Office, Partial International Search Report issued in PCT Application No. PCT/US2007/084042 mailed Mar. 17, 2008 (5 pages).
MAC Valves, Inc., MAC Series 33, Direct Solenoid and Solenoid Pilot Operated Valves, 8mm Valve, product catalog , undated, 5 pages.
Frates, U.S. Appl. No. 11/935,770, filed Nov. 5, 2007.
U.S. Patent and Trademark Office, Office Action in U.S. Appl. No. 11/935,770, Mar. 8, 2011.

* cited by examiner

*Primary Examiner* — Lien Ngo
(74) *Attorney, Agent, or Firm* — Wood, Herron & Evans, L.L.P.

(57) ABSTRACT

An apparatus for dispensing an adhesive generally comprises a dispensing module, a liquid supply component configured to supply the adhesive to the dispensing module, and an attachment system. The attachment system includes a stationary component and an attachment member pivotally coupled to the stationary component. The attachment member is configured to apply a clamping force to the dispensing module to couple the dispensing module to the liquid supply component.

29 Claims, 8 Drawing Sheets

LIQUID DISPENSING APPARATUS INCLUDING AN ATTACHMENT MEMBER

CROSS-REFERENCE TO RELATED APPLICATIONS

This application claims the benefit of U.S. Provisional Patent Application Ser. No. 60/865,886, filed Nov. 15, 2006 and entitled "Dispensing Apparatus Having a Pivot Actuator," the disclosure of which is expressly incorporated by reference herein in its entirety.

TECHNICAL FIELD

The present invention relates generally to liquid dispensers, and more specifically to hot melt adhesive dispensers having a dispensing module attached to a liquid supply component.

BACKGROUND

A typical apparatus for dispensing a heated liquid, such as hot melt adhesive, generally includes a dispensing gun or module having a valve element that opens and closes a dispensing outlet. The valve element is positioned within a passage supplied with pressurized liquid and contacts a valve seat to prevent the heated liquid from flowing to the outlet. To dispense the heated liquid, an actuator, such as an electrically and/or pneumatically operated actuator, causes the valve element to move away from the valve seat and allows the heated liquid to flow from the passage to the outlet. A biasing mechanism, such as a spring, or the same actuator may then cause the valve element to move back toward the valve seat to close the outlet.

The dispensing module typically receives the heated liquid from a liquid supply component, such as a manifold. For example, a manifold may be coupled to both a source of the liquid adhesive and an inlet of the dispensing module. The heated liquid flows through various internal passageways within the manifold before reaching the inlet of the dispensing module. Because the dispensing module and manifold are separate components, they must typically be coupled together in a secure manner to prevent leakage.

One method for coupling the dispensing module to the manifold uses conventional fasteners. For example, one or more screws may be inserted through the dispensing module to engage threaded holes tapped into the manifold. The screws are tightened (i.e., placed in tension) until the dispensing module is pressed against the manifold with sufficient force to maintain a seal between an outlet of the manifold and the inlet of the dispensing module.

In some liquid dispensers, several factors can make the use of screws and other conventional fasteners challenging. For example, a heater within the manifold typically creates an environment of relatively high temperatures. The forces required to effectively couple the dispensing module to the manifold may exceed the pullout strength of the screws at such relatively high temperatures. As a result, tightening the screws to secure the dispensing module may lead to failure of the screw threads, failure of the threads in the tapped hole of the manifold, or both.

Another factor that can make the use of screws and other conventional fasteners challenging relates to the space required to accommodate the screws. Both the dispensing module and manifold include internal passages for the heated liquid that should be avoided by the screws. Because of the limited space available for the screws, the size of the screws themselves is typically limited. Smaller screws have lower resistance to failure than larger screws. As a result, a greater number of smaller screws may be required to press the dispensing module against the manifold with the same amount of force that would be applied if larger screws were used. Finding the space to accommodate more screws can be difficult due to the space limitations discussed above.

Moreover, in some liquid dispensers, the manifold further includes a piston or piston assembly that actuates a pivot arm connected the valve element within the dispensing module. Examples of such heated liquid dispensers assigned to the assignee of the present invention are described in U.S. Patent Application Publication Nos. 2005/0236438 and 2006/0097010 and U.S. Provisional Patent Application Serial No. 60/865,886, the disclosures of which are fully incorporated herein by reference. The additional passages needed to accommodate the piston and pivot arm, along with the relatively small thicknesses associated with these dispensers, may make it even more difficult to accommodate screws or other conventional fasteners.

Therefore, new devices and methods for coupling a dispensing module to a liquid supply component, such as a manifold, are highly desirable.

SUMMARY

An apparatus for dispensing an adhesive that offers an attachment system for coupling a dispensing module to a liquid supply component is provided. If desired, the attachment system may be used to couple the dispensing module to the liquid supply component without the use of conventional fasteners extending through the dispensing module to the liquid supply component. Alternatively, the attachment system may be combined with conventional fastening techniques to couple the dispensing module to the liquid supply component.

To this end, one embodiment of such an attachment system generally comprises a stationary component and an attachment member. The attachment member includes a first portion configured to be pivotally coupled to the stationary component and a second portion configured to apply a clamping force to the dispensing module to couple the dispensing module to the stationary component. The stationary component may be, for example, a portion of the liquid supply component or a separate component secured to the liquid supply component.

The attachment system may be incorporated into an adhesive dispensing apparatus having a dispensing module. The dispensing module may include, for example, a liquid inlet, an internal passage communicating with the liquid inlet, an outlet communicating with the internal passage, and a valve element movable within the internal passage to selectively allow and prevent flow of adhesive through the outlet. Additionally, the attachment member in the attachment system may include an opening extending through the first portion and may be movable between a first position in which it applies the clamping force and a second position in which it allows the dispensing module to be moved away from the stationary component. The stationary component may include a hole configured to engage a fastener after the fastener is inserted through the opening in the attachment member when the attachment member is in the first position.

In another embodiment, the adhesive dispensing apparatus further includes a liquid supply component, such as a manifold or service block. Again, the stationary component in the attachment system may be an integral part of the liquid supply component or may be a separate component secured to the liquid supply component to form an assembly.

The attachment system may be incorporated into a wide variety of liquid dispensing apparatuses having one or more dispensing modules and one or more liquid supply components. In one illustrative embodiment, an adhesive dispensing apparatus includes a plurality of dispensing modules and a plurality of attachment systems, which may correspond to the plurality of dispensing modules. The attachment member in each attachment system includes a first portion pivotally coupled to an associated stationary component or a common stationary component, such as a liquid supply component that supplies the adhesive to the plurality of dispensing modules. Also, the attachment members may each include a second portion configured to apply a clamping force to a corresponding one of the plurality of dispensing modules or to several of the dispensing modules.

In another embodiment, a dispensing module comprises a body having a top surface, a front surface, an inlet surface opposite the front surface, a liquid inlet on the inlet surface, an internal passage communicating with the liquid inlet, an outlet communicating with the internal passage, and a valve element movable within the internal passage to selectively allow and prevent flow of the adhesive through the outlet. A recess defined in the front surface of the body includes a first section extending downwardly from the top surface, the first section being shaped to accommodate an elongate section of an attachment member, and a second section shaped to accommodate a head section of the attachment member. Additionally, at least a portion of the first section may have a first depth relative to the front surface and at least a portion of the second section may have a second depth greater than the first depth so as to define an overhang in the recess.

When a liquid dispensing apparatus incorporates an attachment member according to one embodiment of the invention, the dispensing module may be easily coupled to the liquid supply component. For example, one method of releasably attaching a dispensing module to a liquid supply component comprises moving the attachment member from a first position to a second position, the attachment member being pivotally coupled to the liquid supply component. The dispensing module is then positioned in a desired position relative to the liquid supply component. Once the dispensing module is positioned, the attachment member is moved from the second position to the first position to retain the dispensing module in the desired position.

Another method of releasably attaching a dispensing module to a liquid supply component comprises positioning the dispensing module in a desired position relative the liquid supply component and positioning an attachment member relative to the dispensing module and the liquid supply component. The attachment member includes a first portion configured to confront the liquid supply component, an opening extending through the first portion, and a second portion configured to confront the dispensing module. A fastener is inserted through the opening in the attachment member and into a hole provided in the liquid supply component. The fastener is then rotated in a first direction to engage internal threads in the hole of the liquid supply component. Because the fastener includes a head retained against the attachment member, the second portion of the attachment member applies a clamping force to the dispensing module when the fastener is sufficiently rotated.

In a further aspect or embodiment of this illustrative method, the first portion of the attachment member is pivotally coupled to the liquid supply component and the attachment member is movable from a first position to a second position. To position the attachment member relative to the dispensing module and the liquid supply component, the attachment member is rotated from the second position to the first position. The attachment member may initially retain the dispensing module in the desired position when rotated into the first position so that the steps involving the fastener may then be performed without having to stabilize or hold the dispensing module with one or more hands. However, the dispensing module may still be stabilized or held if desired.

BRIEF DESCRIPTION OF THE DRAWINGS

The accompanying drawings, which are incorporated in and constitute a part of this specification, illustrate exemplary embodiments of the invention.

DETAILED DESCRIPTION

Figure 1:
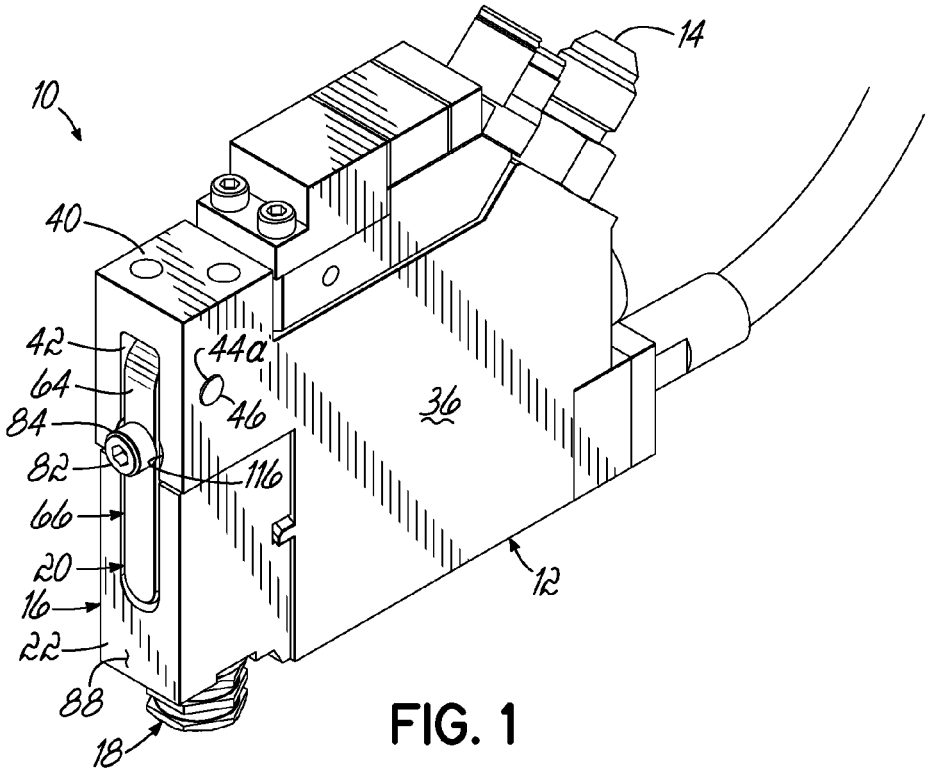
FIG. 1 is a perspective view of an apparatus for dispensing heated liquid according to one illustrative embodiment.

FIGS. 1-6 show one illustrative embodiment of an apparatus 10 for dispensing a liquid, which may be an adhesive. Furthermore, the liquid may be a heated liquid, such as hot melt adhesive. The apparatus 10 generally comprises a liquid supply component 12 (sometimes referred to as a manifold or service block) adapted to receive adhesive through an inlet port 14 and a dispensing module 16 in fluid communication with the liquid supply component 12 and adapted to dispense the adhesive through a nozzle 18. The dispensing module 16 may be coupled to the liquid supply component 12 by an attachment member 20, as will be explained in greater detail below. Although internal structure of the dispensing module 16 and liquid supply component 12 will be briefly described as well, those skilled in the art will appreciate that the attachment member 20 may be incorporated into other types of liquid dispensers to couple a dispensing module to a liquid supply component.

Figure 3:
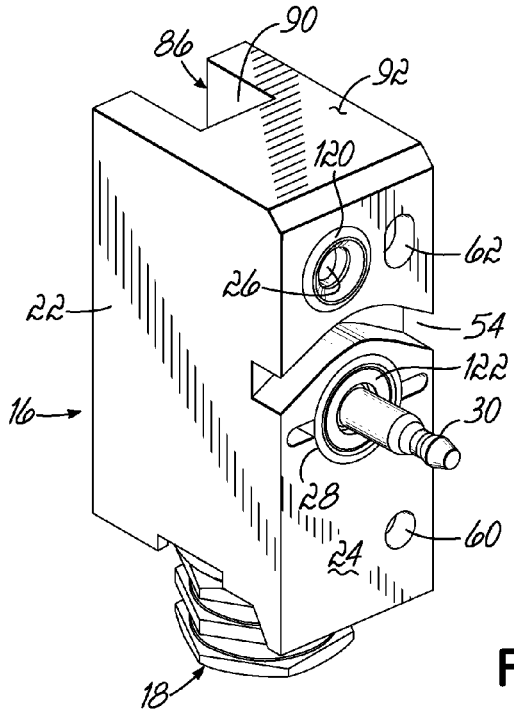
FIG. 3 is a perspective view of the dispensing module of FIG. 2.
Figure 6:
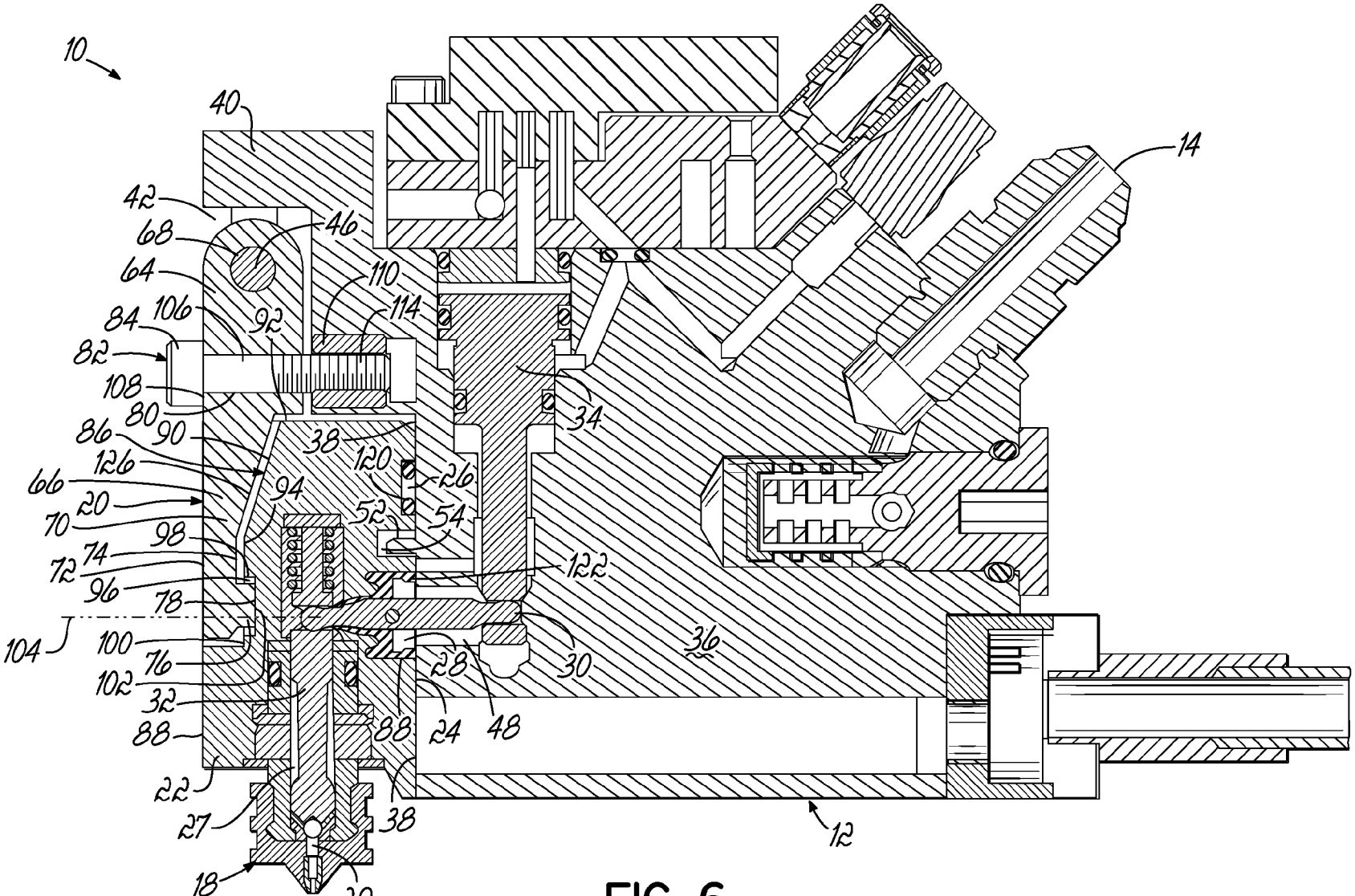
FIG. 6 is a schematic cross-sectional view of the apparatus of FIG. 1.

In one embodiment, the apparatus 10 is a gun and the liquid supply component 12 is a manifold that supplies adhesive to the dispensing module 16. For example, FIGS. 3 and 6 show the dispensing module 16 including a dispensing module body 22 having an inlet surface 24 with a liquid inlet 26 for receiving the adhesive. The liquid inlet 26 communicates with an internal passage 27 within the dispensing module body 22, which in turn communicates with an outlet 29 leading to the nozzle 18. A hole or opening 28 may also be provided on the inlet surface 24 to accommodate a pivot arm 30 for actuating a valve element 32 within the internal passage. For a more complete description of how the pivot arm 30 may be driven by an air-actuated piston 34 within the liquid supply component 12 to move the valve element 32, reference can be made to U.S. Provisional Patent Application Ser. No. 60/865,886. As discussed above, the disclosure of this copending application is fully incorporated herein by reference. The apparatus 10 may alternatively be another type of gun or liquid dispenser, such as an electric gun (not shown) that does not include an air-actuated piston.

Additionally, those skilled in the art will appreciate that the liquid supply component 12 may alternatively be a manifold or service block that supplies liquid to multiple dispensing modules 16. FIG. 1A schematically illustrates a liquid supply component 12', which is an example of such a manifold or service block. Components associated with the liquid supply component 12' for supplying adhesive and/or actuating a valve element within each dispensing module 16 (e.g., by means of a pivot arm) are not shown for clarity.

Figure 2:
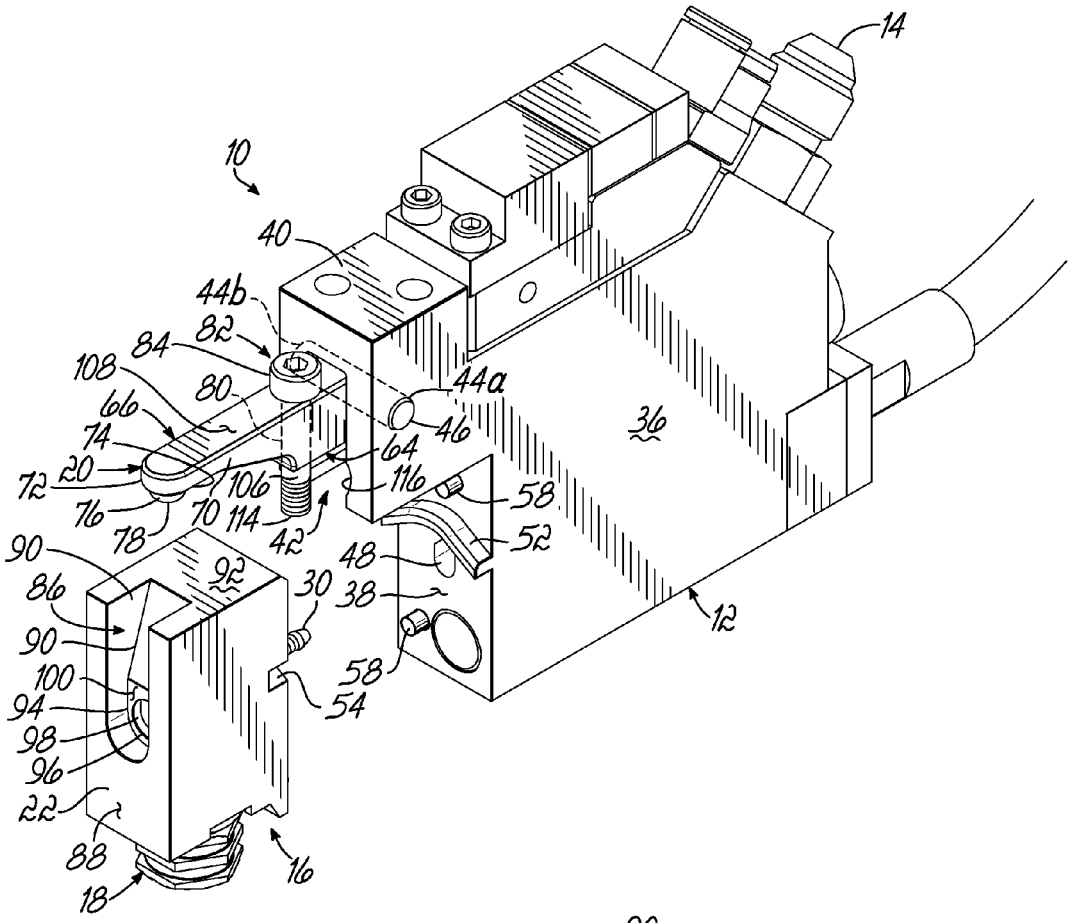
FIG. 2 is a perspective view of the apparatus of FIG. 1, showing a dispensing module disassembled from a liquid supply component.

Now referring to FIGS. 2 and 3, the liquid supply component 12 includes a main body portion 36 having a front surface 38 and a front body portion 40 extending from the main body portion 36 above the front surface 38. The front body portion 40 defines a channel 42 and includes opposed pin holes 44*a*, 44*b* for accommodating a pivot pin 46 that extends through the channel 42. Because adhesive is transferred between the liquid supply component 12 and the dispensing module 16, the liquid supply component 12 may further include a number of additional features on the front surface 38 to accurately interface with the dispensing module 16 and to prevent leakage. For example, when the liquid supply component 12 and the dispensing module 16 are assembled, the pivot arm 30 may enter an opening 48 provided in the front surface 38. Additionally, a flow dam 52 extending from the front surface 38 may register with a similarly-shaped channel 54 formed in the dispensing module 16, so that together the flow dam 52 and channel 54 can divert any leaking adhesive away from the pivot arm 30. Although the flow dam 52 and channel 54 are shown as having an arcuate configuration, these components may alternatively have a circular configuration. Alignment may be aided by dowel pins 58, a dowel hole 60, and a dowel slot 62, although a variety of other alignment devices may be used to accurately align the dispensing module 16 and liquid supply component 12. The number of alignment devices may also vary (e.g., only one dowel pin may be used in some embodiments).

The attachment member 20 is movable from a first position in which it couples the dispensing module 16 to the liquid supply component 12 and a second position in which it allows the dispensing module 16 to be moved away from the liquid supply component 12, as will be described below. Those skilled in the art will appreciate that the attachment member 20 may be any type of lever, latch, handle, or other structure configured to be coupled to the liquid supply component 12 and configured to apply a clamping force to the dispensing module 16 to secure the dispensing module 16 relative to the liquid supply component 12.

For example, with reference to FIGS. 2 and 6, the attachment member 20 may include a first portion 64 pivotally coupled to the front body portion 40 of liquid supply component 12 and a second portion 66 extending from the first portion 64. More specifically, the first portion 64 is received in the channel 42 and may include a pivot hole 68 for receiving the pivot pin 46 so as to be rotatably supported thereby. The second portion 66 may include an elongate section 70 and a head section 72, with the head section 72 having a bottom surface 74 configured to confront (i.e., face) the dispensing module 16. A projection 76 extends outwardly from the bottom surface 74 and terminates in a clamping surface 78.

The attachment member 20 may further include an opening, such as a fastener hole 80, through which a fastener 82 passes. In the illustrative embodiment shown in FIGS. 2 and 6, the fastener hole 80 is located in the first portion 64 between the between pivot hole 68 and the second portion 66. The first portion 64 has a greater thickness than the second portion 66 to strengthen the attachment member 20 in the area surrounding the fastener hole 80 so that greater forces may be exerted by a head 84 of the fastener 82, as will be described in greater detail below. Because of the different thicknesses in the attachment member 20, the elongate section 70 may decrease in thickness as it extends from the first portion 64 to the head section 72. The thicknesses, shapes, and spatial relationships between the first portion 64, second portion 66, pivot hole 68, and fastener hole 80 are not meant to be limiting, as other combinations of these features, if properly arranged, will also work.

The second portion 66 of attachment member 20 is configured to be received into a recess 86 defined in a front surface 88 of the dispensing module body 22. The recess 86 may include: 1) a first section 90 extending downwardly from a top surface 92 of the dispensing module body 22 and shaped to accommodate the elongate section 70, and 2) a second section 94 shaped to accommodate the head section 72. To this end, the first section 90 may be tapered so as to decrease in depth (relative to the front surface 88) as the first section 90 extends downwardly from the top surface 92, much like the elongate section 70 of the attachment member 20.

In one embodiment, at least a portion of the first section 90 has a first depth and at least a portion of the second section 94 has a second depth greater than the first depth so as to define an overhang in the recess 86. For example, the second section 94 may include a socket 96 defined by a substantially cylindrical surface 98 extending from a bottom surface 100 to a contact surface 102 located at the second depth. The head section 72 of the attachment member 20 may have a shape substantially corresponding to that of the socket 96, with the clamping surface 78 configured to contact the contact surface 102. Additionally, the socket 96 may be aligned along a common axis 104 with the opening 28 on the inlet surface 24 so that clamping forces are applied by the clamping surface 78 substantially opposite the pivot arm 30. As will be described in greater detail below, these clamping forces may counteract opposing forces from adhesive pressure and pivot arm action that tend to force the dispensing module 16 and liquid supply component 12 apart. However, those skilled in the art will appreciate that attachment member 20 and/or recess 86 may be designed so that the clamping force is applied at any desired location along dispensing module body 22. Additionally, those skilled in the art will appreciate that attachment member 20 may be designed to apply the clamping force directly to the front surface 88 of dispensing module body 22. To this end, the dispensing module body 22 may or may not be designed with the recess 86.

Figure 4:
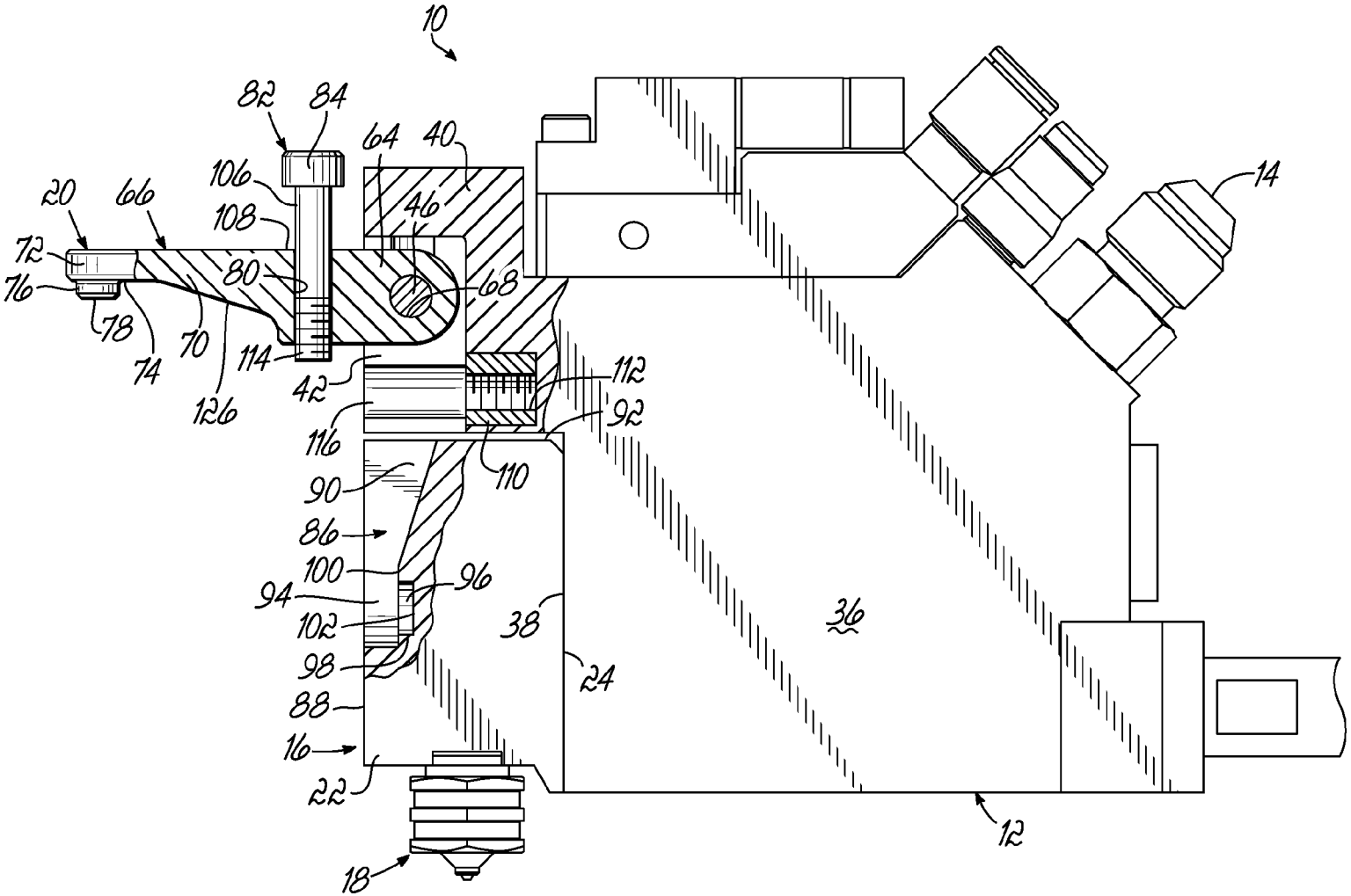
FIG. 4 is a partial cross-sectional view of the apparatus of FIG. 1, showing an attachment member in a position operative to allow the dispensing module to be moved away from the liquid supply component.

As shown in FIG. 4, fastener 82 includes a shaft 106 extending through the fastener hole 80 and a head 84 configured to be retained against a seating surface 108 on the attachment member 20. A threaded insert 110 having female threads 112 configured to receive and engage male threads 114 on the shaft 106 is secured in the main body portion 36 of liquid supply component 12. The threaded insert 110 may be formed from a material stronger than that of the main body portion 36. For example, when the main body portion 36 is formed from aluminum, the threaded insert 110 may be formed from steel. Such an arrangement helps prevent deformation of the female threads 112, especially at elevated temperatures. The installation of the threaded insert 110 may be made possible by arcuate portions 116, which may be machined by a counter-boring process or otherwise formed in the channel 42. Additionally, the arcuate portions 116 may provide clearance for the head 84 of fastener 82, depending on which type of fastener is used.

In alternative embodiments, female threads (not shown) could be directly formed, such as by tapping, into the main body portion 36 to receive and engage the male threads 114, if material properties and service requirements indicated that the female threads would perform satisfactorily.

Referring to FIGS. 1, 2, 4, and 5, one embodiment of an assembly and disassembly process and certain functional aspects of structural features previously described will now be explained.

Figure 1A:
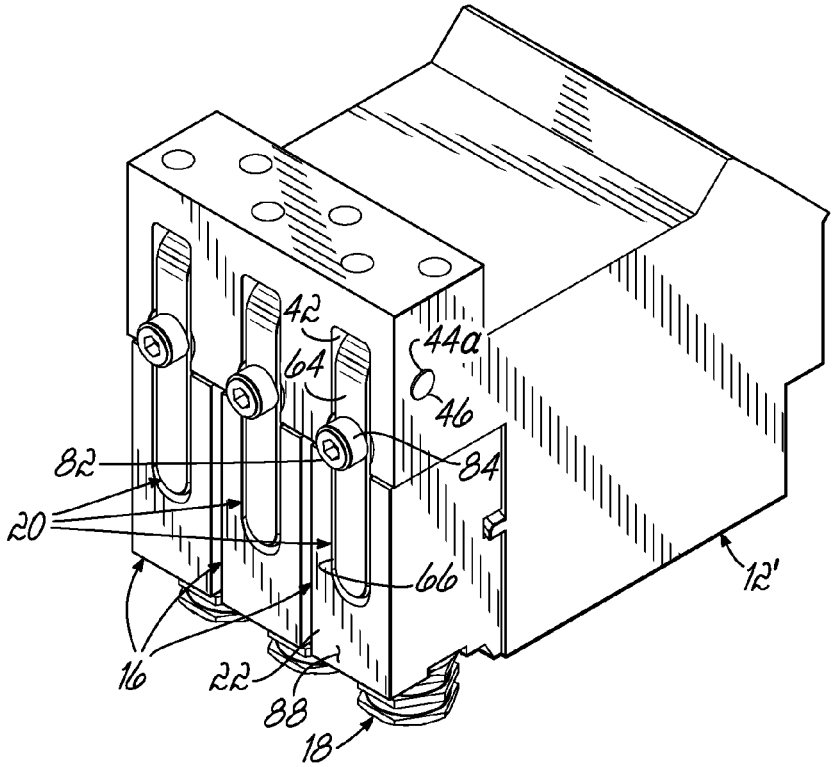
FIG. 1A is a perspective view of an apparatus for dispensing heated liquid according to another illustrative embodiment.

Starting with FIG. 1, showing the dispensing module 16 assembled to the liquid supply component 12 and the attachment member 20 in a first position, and proceeding to FIG. 2, the fastener 82 is loosened so that the male threads 114 are disengaged from the female threads 112 in the liquid supply component 12. To provide rotational clearance, the fastener 82 is fully or partially removed from the attachment member 20, and the attachment member 20 is rotated about the pivot pin 46 to the second position. The dispensing module 16 may then be pulled away from the liquid supply component 12.

Referring to FIG. 4, the dispensing module 16 and the liquid supply component 12 are shown brought together with the fastener 82 retracted from the attachment member 20 in preparation for rotating the attachment member 20 into the recess 86. When the attachment member 20 is rotated to bring the projection 76 into engagement with the socket 96, the projection 76 may initially retain the dispensing module 16 in the proper position until the male threads 114 of the fastener 82 are brought into engagement with the female threads 112 of the threaded insert 110. Alternatively, the design of a protrusion and a socket may be reversed, with the attachment member 20 having a socket, and the dispensing module 16 having a protrusion, or any similar physical interaction of shapes could be used. Conventional dispensing modules and liquid supply components, without an attachment member, typically require the dispensing module 16 to be held while inserting a screw or other fastener through the dispensing module 16 to the liquid supply component 12.

Figure 5:
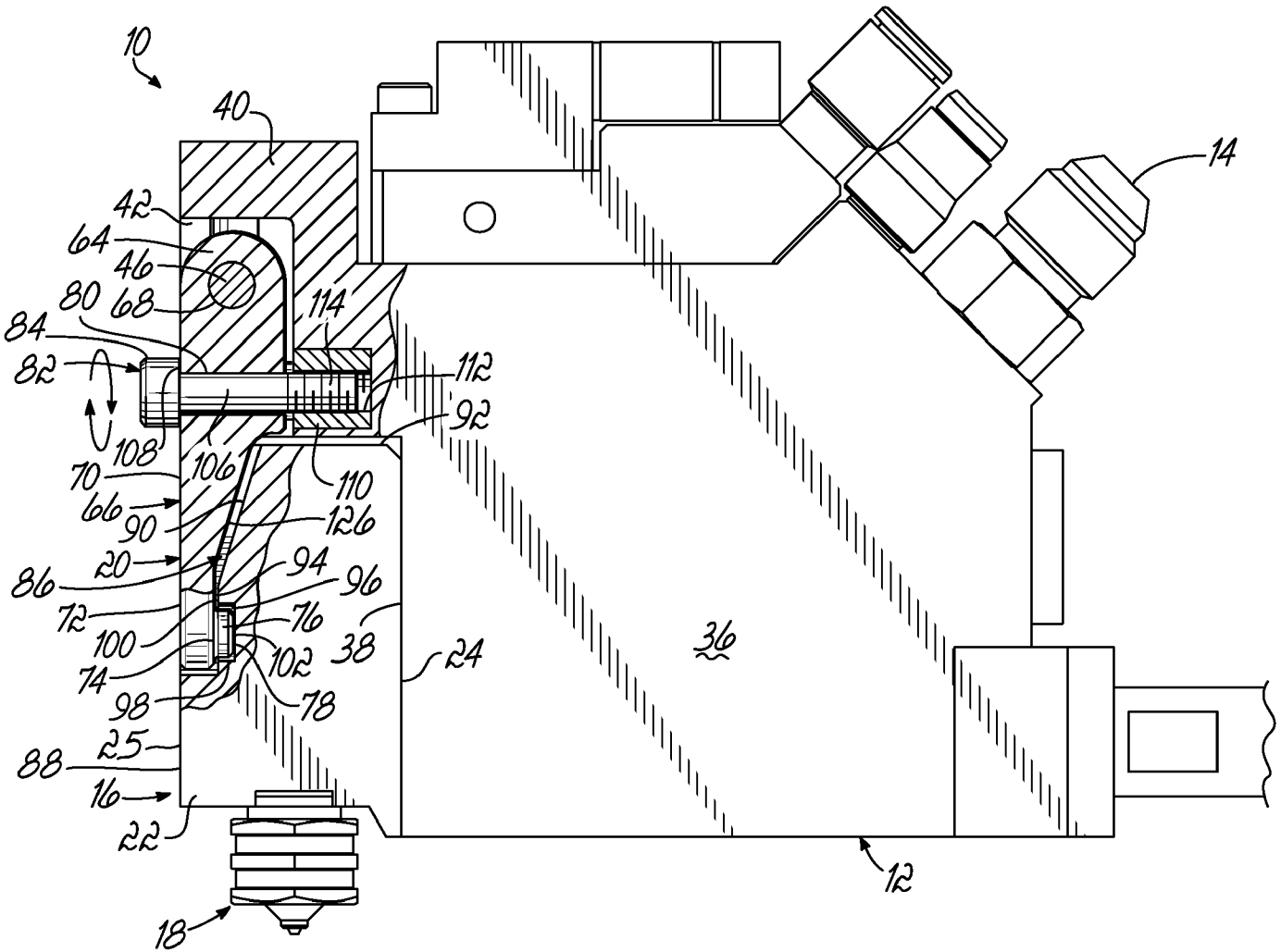
FIG. 5 is a partial cross-sectional view similar to FIG. 4, showing an attachment member in a position operative to securely retain the dispensing module relative to the liquid supply component.

Referring to FIG. 5, the attachment member 20 has been rotated into position, and the fastener 82 has been placed in tension to bring the head 84 into contact with the seating surface 108. The tension force in the fastener 82 is transformed by the head 84 and attachment member 20 into a compressive clamping force applied to the inlet surface 24 and front surface 38. Advantageously, applying the compressive clamping force substantially perpendicularly to the inlet surface 24 and front surface 38, and not laterally, helps evenly compress seals—such as a liquid inlet seal 120 (FIG. 3) around the liquid inlet 26 and a pivot arm seal 122 (FIG. 3) around the pivot arm 30—to maintain proper contact between the dispensing module 16 and liquid supply component 12. Failure to apply substantially perpendicular compressive forces may allow leakage, or may decrease the life of the liquid inlet seal 120 or the pivot arm seal 122. Furthermore, when the force is applied perpendicularly, it can best counteract the opposing forces from adhesive pressure and pivot arm action that tend to force apart the front surface 38 and the inlet surface 24. In this embodiment, to allow forceful contact between the clamping surface 78 and contact surface 102, other nearby surfaces, such as a bottom surface 126 of elongate section 70 and the bottom surface 74 of head section 72 do not contact the dispensing module body 22. It is appreciated by one skilled in the art that other designs could utilize intentional contact at the bottom surface 126 and/or bottom surface 74.

As an alternative to the particular fastener system described in the embodiment of FIGS. 1-7, other similar fastener systems could be used. Examples of other systems include, without limitation: a stud with a nut or finger knob, a clamp, or any other structure that can apply a force to the attachment member 20 in a similar manner as the fastener 82. Additionally, rather than being pivotally coupled to the liquid supply component 12, the attachment member 20 may simply be coupled by the fastener 82 alone or in combination with another coupling technique.

With reference to FIG. 6, a cross-section of the apparatus 10 is shown. This figure shows an example of the many internal passages that are avoided by not having fasteners passing through dispensing module 16 (i.e., from front surface 88 to the inlet surface 24) and into liquid supply component 12. Indeed, the dispensing module body 22 need not include any holes extending from the front surface 88 to the inlet surface 24 for receiving a fastener.

Figure 7:
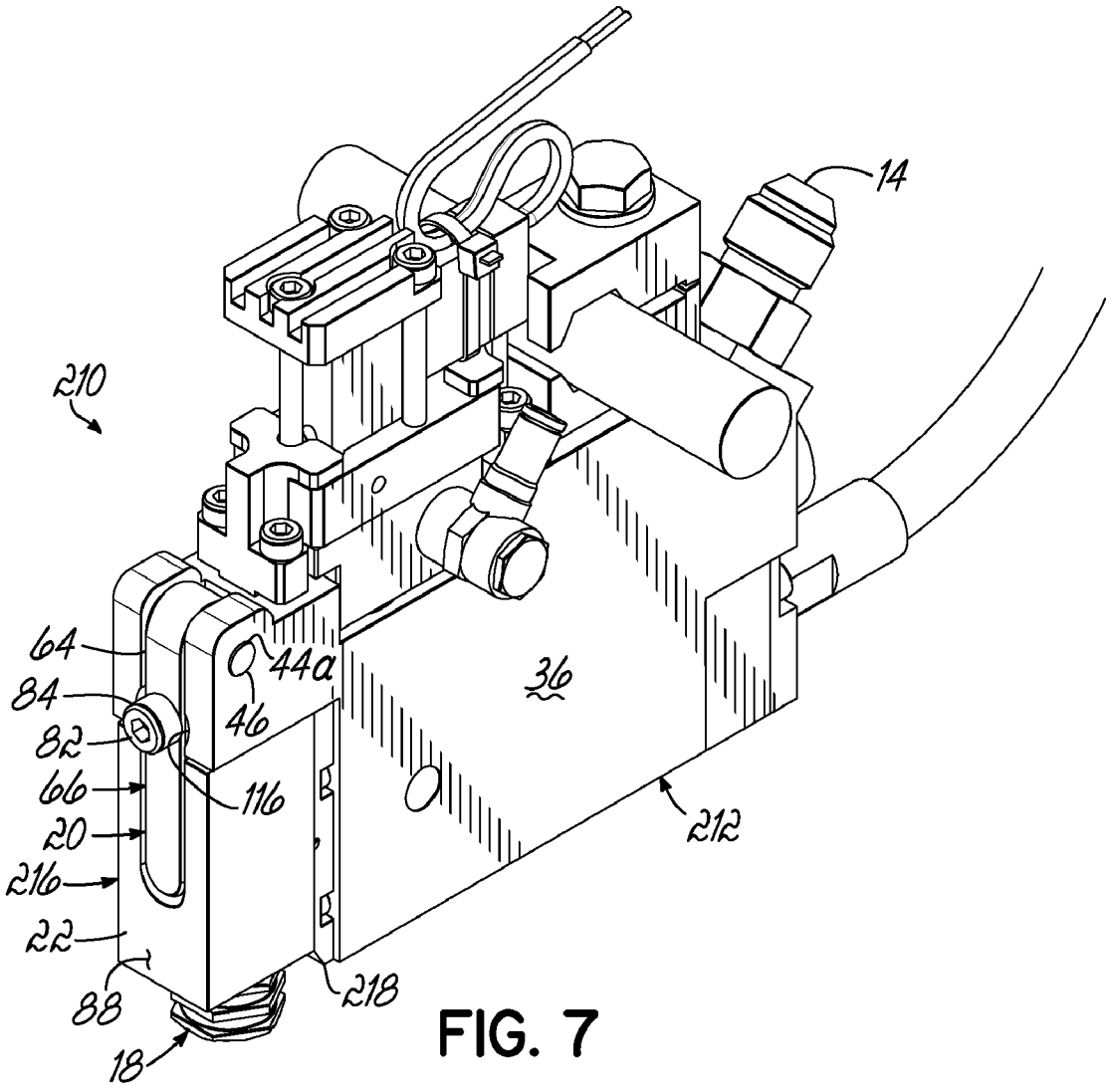
FIG. 7 is a perspective view of an apparatus for dispensing heated liquid according to another illustrative embodiment.

With reference to FIG. 7, another embodiment of a dispensing apparatus 210 includes a dispensing module 216 coupled to a liquid supply component 212. The dispensing module 216 may be coupled to the liquid supply component 212 by the attachment member 20 in the same manner as the dispensing module 16 and the liquid supply component 12, respectively. Accordingly, like reference numbers will be used to refer to like structure from FIGS. 1-6. In the dispensing apparatus 210, however, an adapter plate 218 is positioned between the dispensing module 216 and the liquid supply component 212. The adapter plate 218 may be removed simultaneously with dispensing module 216 when the attachment member 20 is in the appropriate position. As a result, the adapter plate 218 maintains the pivot arm seal 122 (FIG. 3) fully seated within the opening 28 during removal to prevent leakage between the dispensing module 216 and pivot arm seal 122. The attachment member 20 may accommodate the adapter plate 218 by making appropriate design changes in the position of pivot pin 46, clamping surface 78 (FIGS. 4-6), or contact surface 102 (FIGS. 4-6) so that the compressive clamping forces remain substantially perpendicular to the inlet surface 24. However, even without exact accommodations, a proportion of clamping forces sufficient for the seals to function properly may still be available.

Figure 8A:
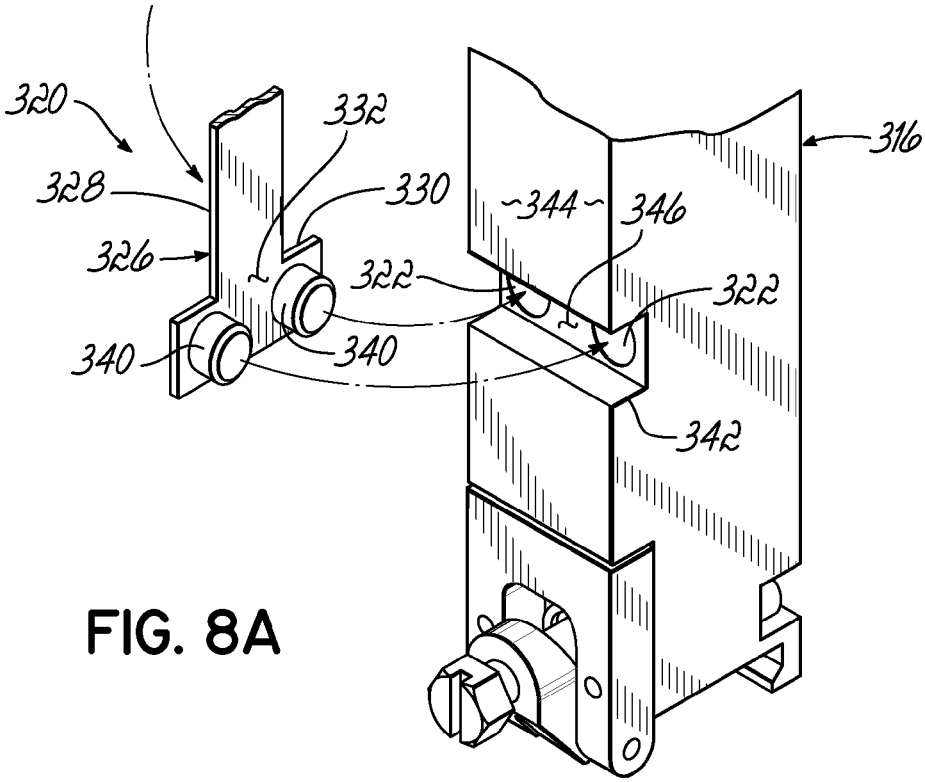
FIGS. 8A and 8B are perspective views of a portion of an attachment member according to one illustrative embodiment being used with a conventional dispensing module.
Figure 8B:
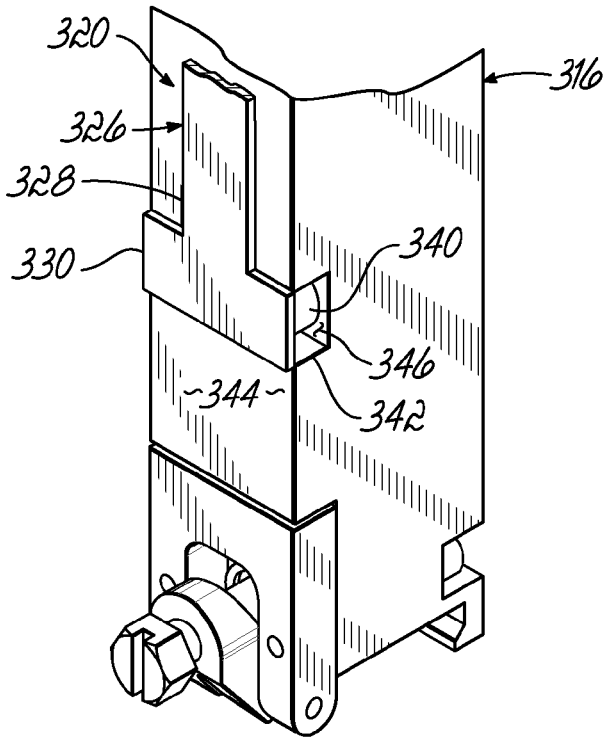

FIGS. 8A and 8B illustrate a dispensing module 316 and attachment member 320 according to another embodiment. The dispensing module 316 may be a conventional dispensing module having one or more holes 322 extending therethrough. The holes 322 are designed to accommodate fasteners (not shown) typically used to couple the dispensing module 316 to a liquid supply component (not shown). Normally such fasteners include a head retained within a recess 342 and against a bottom surface 346 of the recess 342. However, rather than inserting such fasteners through the dispensing module 316, the attachment member 320 may be used to apply a clamping force to the dispensing module 316 in a manner similar to the attachment member 20 (FIG. 1).

For example, the attachment member 320 may be pivotally coupled to a liquid supply component in a manner similar to the attachment member 20. Because reference can be made to the description of attachment member 20 and liquid supply component 12 for a more complete understanding of such a coupling arrangement, a first portion of attachment member 320 and a liquid supply component are not shown in FIGS. 8A and 8B. A second portion 326 of attachment member 320 may include an elongate section 328 and head section 330 arranged to provide the second portion 326 with a substantially T-shaped configuration, although other configurations are also possible. The elongate section 328 and head section 330 may have substantially the same thickness as shown, or may have different thicknesses like the elongate section 70 and head section 72 of attachment member 20 (FIGS. 2 and 4-6).

A bottom surface 332 defined by both the elongate section 328 and head section 330 confronts the dispensing module 316 when the attachment member 320 is moved into a position to apply the clamping force to the dispensing module 316. In some embodiments, the attachment member 320 may further include projections 340 extending from the bottom surface 322. The projections 340 may be received in the recess 342, which is defined across a front surface 344 of dispensing module 316, and the head section 330 may be shaped to substantially cover the recess 342. The projections 340 may be sized and shaped to contact the bottom surface 346 when the attachment member 316 is in the position shown in FIG. 8B.

Those skilled in the art will appreciate that there may be some embodiments in which the holes 322 include a counterbore (not shown) to accommodate the heads of the fasteners typically used to secure the dispensing module 316. The recess 342 may or may not be defined in the front surface 344 of dispensing module 316 in such embodiments. Additionally, the projections 340 may be sized and shaped to at least partially extend into the holes 322. For example, the projections 340 may be retained within the counterbores much like the heads of the fasteners typically used to secure the dispensing module 316. The number of projections 340 may therefore correspond to the number of holes 322 in the dispensing module 316.

Figure 9:
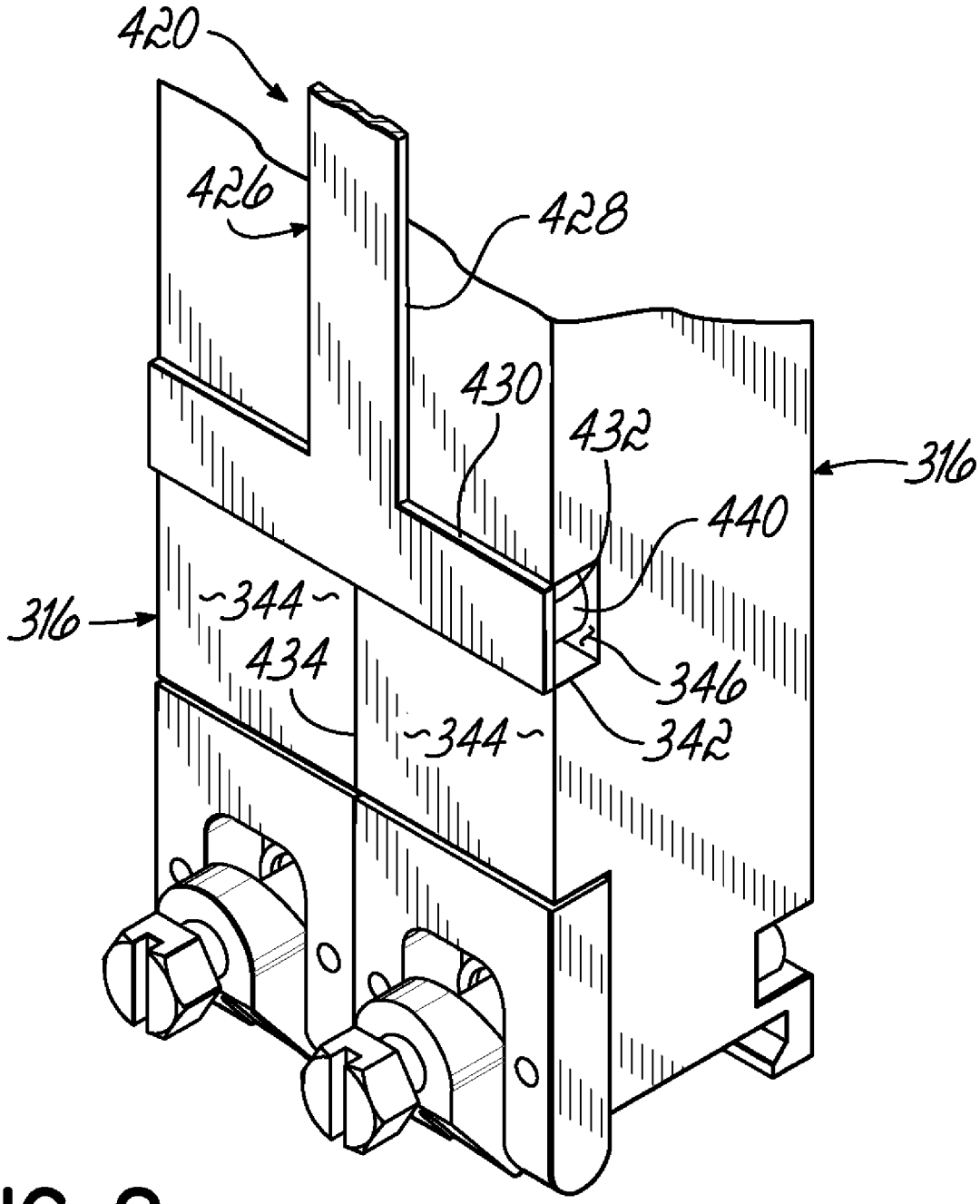
FIG. 9 is a perspective view of an attachment member according to another illustrative embodiment being used with two dispensing modules.

FIG. 9 illustrates an attachment member 420 according to yet another embodiment, with like reference numbers being used to refer to like structure from the embodiment in FIGS. 8A and 8B. The attachment member 420 may be used to couple two or more of the dispensing modules 316 to a liquid supply component (not shown) in the form of a manifold or service block. Again, because a first portion of the attachment member 420 may be coupled to a liquid supply component in a manner similar to the attachment member 20, only a second portion 426 of attachment member 420 is shown.

The second portion 426 may include an elongate section 428 and a head section 430 configured to extend across at least a portion of two or more of the dispensing modules 316. For example, the second portion 426 may have a T-shaped configuration with the head section 430 covering the recesses 342 and the elongate section 428 extending over the front surfaces 344 at an interface 434 between the dispensing modules 316. The attachment member 420 may also include projections 440 extending from a bottom surface 432 in a manner similar to the attachment member 320. Accordingly, the discussion above with respect to the projections 340 (FIGS. 8A and 8B) applies equally to the projections 440.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, the attachment member 20 may alternatively include the fastener hole 80 in a portion extending beyond the pivot hole 68, thus making the pivot pin 46 into a fulcrum on which the attachment member 20 pivots. In such an example (not shown), a fastener or other device could be used in compression, rather than tension, to create a force at the clamping surface 78 that would push the dispensing module 16 against the liquid supply component 12.

Additionally, although the attachment member 20 is shown as being coupled to the front body portion 40 of liquid supply component 12, other arrangements are possible in which the attachment member 20 may be coupled to a separate component (not shown) mounted on, attached, or otherwise secured to the liquid supply component 12. Such an arrangement allows conventional liquid supply components to be modified to utilize the attachment members 20, 320, and 420 regardless of whether liquid supply components are designed with front body portion 40. To this end, those skilled in the art will appreciate that the attachment members described above may be part of an attachment system that includes a stationary component, which may be a portion of a liquid supply component (such as the front body portion 40 of liquid supply component 12) or a separate component secured to a liquid supply component.

Therefore, the invention in its broader aspects is not limited to the specific details, representative apparatus and methods and illustrative examples shown and described. Accordingly, departures may be made from such details without departing from the scope or spirit of the general inventive concept.

What is claimed is:

1. An apparatus for dispensing an adhesive, comprising:

a dispensing module having a liquid inlet, an internal passage communicating with said liquid inlet, an outlet communicating with said internal passage, and a valve element movable within said internal passage to selectively allow and prevent flow of adhesive through said outlet; and an attachment system, including:

a stationary component; and an attachment member having a first portion pivotally coupled to said stationary component and a second portion configured to apply a clamping force to said dispensing module to couple said dispensing module to said stationary component, wherein said dispensing module includes a recess configured to at least partially receive said second portion of said attachment member.

2. The apparatus of claim 1 wherein said attachment member further includes an opening extending through said first portion and is movable between a first position in which said attachment member applies the clamping force and a second position in which said attachment member allows said dispensing module to be moved away from said stationary component, said stationary component including a hole configured to engage a fastener after the fastener is inserted through said opening of said attachment member when said attachment member is in said first position.

3. The apparatus of claim 1 wherein said second portion of said attachment member includes an elongate section and a head section, said head section defining a bottom surface and at least one projection extending from said bottom surface, said at least one projection having a clamping surface configured to contact the dispensing module.

4. The apparatus of claim 3 wherein said recess includes a first section shaped to accommodate said elongate section of said attachment member and a second section shaped to accommodate said head section of said attachment member.

5. The apparatus of claim 3 wherein said elongate section and said head section are configured to provide said second portion with a substantially T-shaped configuration, said dispensing module including a front face with said recess extending across said front face, and said head section being configured to cover at least a portion of said recess.

6. An apparatus for dispensing an adhesive, comprising:

a dispensing module having a liquid inlet, an internal passage communicating with said liquid inlet, an outlet communicating with said internal passage, and a valve element movable within said internal passage to selectively allow and prevent flow of adhesive through said outlet; and an attachment system, including:

a stationary component; and an attachment member having a first portion pivotally coupled to said stationary component and a second portion configured to apply a clamping force to said dispensing module to couple said dispensing module to said stationary component, wherein said dispensing module includes at least one hole normally configured to receive a fastener and said second portion of said attachment member includes a bottom surface and at least one projection extending from said bottom surface, said at least one projection configured to at least partially extend into said at least one hole when said attachment member applies the clamping force to said dispensing module.

7. The apparatus of claim 1, further comprising:

a liquid supply component configured to supply the adhesive to said liquid inlet, wherein said stationary component is secured to said liquid supply component to form an assembly.

8. The apparatus of claim 1, further comprising:

a liquid supply component configured to supply the adhesive to said liquid inlet, wherein said stationary component is formed integrally with said liquid supply component.

9. The apparatus of claim 8, further comprising:

an adapter plate positioned between said dispensing module and said liquid supply component, said attachment member being configured to securely retain said dispensing module against said adapter plate.

10. The apparatus of claim 1 wherein said liquid inlet is located on an inlet surface of said dispensing module, said attachment member being configured to apply the clamping force to said dispensing module in a direction substantially perpendicular to said inlet surface.

11. The apparatus of claim 1, further comprising:

at least one additional dispensing module; and at least one additional attachment system corresponding to said at least one additional dispensing module.

12. The apparatus of claim 1, further comprising:

at least one additional dispensing module, said second portion of said attachment member configured to extend across portions of at least two of said dispensing modules so that said attachment member is configured to apply a clamping force to said at least two dispensing modules.

13. The apparatus of claim 12 wherein said second portion of said attachment member includes an elongate section and a head section configured to provide said second section with a substantially T-shaped configuration, said head section being configured to extend across said at least two dispensing modules.

14. An apparatus for dispensing an adhesive, comprising:

a dispensing module having a liquid inlet, an internal passage communicating with said liquid inlet, an outlet communicating with said internal passage, and a valve element movable within said internal passage to selectively allow and prevent flow of adhesive through said outlet;

a liquid supply component configured to supply the adhesive to said dispensing module, said liquid supply component including a hole with internal threads; and an attachment system, including:

a stationary component formed integrally with said liquid supply component; and an attachment member having a first portion pivotally coupled to said stationary component, an opening extending through said first portion and configured to receive a fastener, and a second portion configured to apply a clamping force to said dispensing module to couple said dispensing module to said stationary component when the fastener received through said opening is engaged with said internal threads in said hole of said liquid supply component so as to produce the clamping force on said attachment member.

15. An attachment system for a liquid dispensing apparatus, comprising:

a stationary component; and an attachment member having a first portion pivotally coupled to said stationary component, an opening extending through said first portion and configured to receive a fastener, and a second portion configured to apply a clamping force to a dispensing module to couple the dispensing module to said stationary component, wherein said second portion of said attachment member includes an elongate section and a head section, said head section defining a bottom surface and at least one projection extending from said bottom surface, said at least one projection having a clamping surface configured to contact the dispensing module, wherein said elongate section and said head section form a substantially T-shaped configuration.

16. A dispensing module for dispensing an adhesive, wherein the dispensing module is configured to be coupled to a liquid supply component by an attachment member having a head section and an elongate section, the dispensing module comprising:

a body having a top surface, a front surface, an inlet surface opposite said front surface, a liquid inlet on said inlet surface, an internal passage communicating with said liquid inlet, an outlet communicating with said internal passage, and a valve element movable within said internal passage to selectively allow and prevent flow of the adhesive through said outlet, said front surface defining a recess including a first section extending downwardly from said top surface and shaped to accommodate the elongate section of the attachment member and a second section shaped to accommodate the head section of the attachment member.

17. The dispensing module of claim 16 wherein at least a portion of said first section of said recess has a first depth relative to said front surface and at least a portion of said second section has a second depth greater than said first depth so as to define an overhang in said recess.

18. The dispensing module of claim 17 wherein said first section of said recess is tapered so as to decrease in depth in a direction extending downwardly from said top surface.

19. The dispensing module of claim 18 wherein said second section of said recess includes a socket defined by a substantially cylindrical surface extending to a contact surface located at said second depth.

20. The dispensing module of claim 16 wherein said body further includes at least one of: (a) an opening on said inlet surface configured to receive a pivot arm for actuating said valve element in said internal passage, said second section of said recess and said opening being substantially aligned along a common axis; or (b) a channel defined in said inlet surface and configured to register with a similarly shaped projection on the liquid supply component.

21. A method of releasably attaching a dispensing module to a liquid supply component, comprising:

moving an attachment member from a first position to a second position, the attachment member being pivotally coupled to the liquid supply component;

positioning the dispensing module in a desired position relative to the liquid supply component when the attachment member is in the second position, the dispensing module having a liquid inlet, an internal passage communicating with the liquid inlet, an outlet communicating with the internal passage, and a valve element movable within the internal passage; and moving the attachment member from the second position to the first position to retain the dispensing module in the desired position, wherein the attachment member includes a first portion pivotally coupled to the liquid supply component and a second portion configured to apply a clamping force to the dispensing module, and wherein moving the attachment member from the second position to the first position comprises rotating the second portion of the attachment member into a recess defined in a front surface of the dispensing module.

22. A method of releasably attaching a dispensing module to a liquid supply component, comprising:

moving an attachment member from a first position to a second position, the attachment member being pivotally coupled to the liquid supply component;

positioning the dispensing module in a desired position relative to the liquid supply component when the attachment member is in the second position, the dispensing module having a liquid inlet, an internal passage communicating with the liquid inlet, an outlet communicating with the internal passage, and a valve element movable within the internal passage;

moving the attachment member from the second position to the first position to retain the dispensing module in the desired position;

inserting a fastener through an opening in the attachment member and into a hole in the liquid supply component, wherein the fastener includes a head larger than a diameter of the opening so as to be retained by the attachment member; and rotating the fastener to engage internal threads in the hole of the liquid supply component and thereby cause the attachment member to apply a clamping force to the dispensing module.

23. A method of releasably attaching a dispensing module to a liquid supply component, comprising:

moving an attachment member from a first position to a second position, the attachment member being pivotally coupled to the liquid supply component;

positioning the dispensing module in a desired position relative to the liquid supply component when the attachment member is in the second position, the dispensing module having a liquid inlet, an internal passage communicating with the liquid inlet, an outlet communicating with the internal passage, and a valve element movable within the internal passage; and moving the attachment member from the second position to the first position to retain the dispensing module in the desired position, wherein the dispensing module has an inlet surface configured to be positioned proximate the liquid supply component, the method further comprising:

applying a clamping force to the dispensing module with the attachment member in a direction substantially perpendicular to the inlet surface.

24. A method of releasably attaching a dispensing module to a liquid supply component, comprising:

moving an attachment member from a first position to a second position, the attachment member being pivotally coupled to the liquid supply component;

positioning the dispensing module in a desired position relative to the liquid supply component when the attachment member is in the second position, the dispensing module having a liquid inlet, an internal passage communicating with the liquid inlet, an outlet communicating with the internal passage, and a valve element movable within the internal passage;

moving the attachment member from the second position to the first position to retain the dispensing module in the desired position;

supplying adhesive to the dispensing module from the liquid supply component;

dispensing the adhesive from the dispensing module;

moving the attachment member from the first position to the second position after the adhesive has been dispensed; and moving the dispensing module away from the liquid supply component.

25. A method of releasably attaching a dispensing module to a liquid supply component, the dispensing module having a liquid inlet, an internal passage communicating with said liquid inlet, an outlet communicating with said internal passage, and a valve element movable within said internal passage to selectively allow and prevent flow of adhesive through said outlet, the method comprising:

positioning the dispensing module in a desired position relative to the liquid supply component;

positioning an attachment member relative to the dispensing module and the liquid supply component, the attachment member including a first portion configured to confront the liquid supply component, an opening extending through the first portion, and a second portion configured to confront the dispensing module;

inserting a fastener through the opening in the attachment member and into a hole provided in the liquid supply component; and rotating the fastener in a first direction to engage internal threads in the hole of the liquid supply component so as to produce a clamping force applied to the attachment member, the fastener including a head retained against the attachment member so that the second portion of the attachment member applies the clamping force to the dispensing module to retain the dispensing module in the desired position when the fastener is sufficiently rotated.

26. The method of claim 25 wherein the first portion of the attachment member is pivotally coupled to the liquid supply component, the attachment member being movable from a first position to a second position, and wherein positioning the attachment member relative to the dispensing module and the liquid supply component comprises:

rotating the attachment member from the second position to the first position.

27. The method of claim 26 wherein rotating the attachment member from the second position to the first position comprises:

rotating the second portion of the attachment member into a recess defined in the dispensing module.

28. The method of claim 26 wherein the attachment member initially retains the dispensing module in the desired position when rotated into the first position.

29. The method of claim 26, further comprising:

rotating the fastener in a second direction to disengage the internal threads from the hole of the liquid supply component;

rotating the attachment member from the first position to the second position; and moving the dispensing module away from the liquid supply component.

* * * * *